United States Patent [19]

Hacknauer et al.

[11] Patent Number: 4,972,887

[45] Date of Patent: Nov. 27, 1990

[54] CONTAINER FOR PARTICULATE MATERIAL

[75] Inventors: Frank Hacknauer, Honeoye Falls; Kenneth Corby; Ronald Vacek, both of Rochester, all of N.Y.

[73] Assignee: Eastman Kodak Company, Rochester, N.Y.

[21] Appl. No.: 360,811

[22] Filed: Jun. 2, 1989

[51] Int. Cl.[5] ..... G03G 15/08

[52] U.S. Cl. ..... 141/346; 141/352; 141/360; 141/364; 141/386; 355/260; 222/DIG. 1

[58] Field of Search ..... 355/260, 245, 326; 141/1, 89, 312, 319–322, 346, 372, 351–354, 360, 375, 362–366, 369, 370, 383, 386; 222/325, 541, 561, DIG. 1; 206/527; 220/331, 346

[56] References Cited

U.S. PATENT DOCUMENTS

| | | | |
|---|---|---|---|
| 4,775,075 | 10/1988 | Kamin et al. | 220/331 |

FOREIGN PATENT DOCUMENTS

| | | | |
|---|---|---|---|
| 60-147767 | 8/1985 | Japan | 355/260 |
| 60-147771 | 8/1985 | Japan | 355/260 |
| 60-254066 | 12/1985 | Japan | 355/260 |
| 63-137259 | 6/1988 | Japan | 355/260 |
| 7506875 | 6/1974 | Netherlands | 222/DIG. 1 |

*Primary Examiner*—Henry J. Recla
*Assistant Examiner*—Casey Jacyna
*Attorney, Agent, or Firm*—Leonard W. Treash, Jr.

[57] ABSTRACT

A container for supplying toner to a receiving apparatus of a copier or printer includes a containing portion having an opening in its bottom. A cover for the opening is slidable between positions covering and uncovering the opening. The cover includes a hinge permitting rotating a major portion of the cover to an unprotruding position when the cover is not covering the opening.

4 Claims, 5 Drawing Sheets

CONTAINER FOR PARTICULATE MATERIAL

TECHNICAL FIELD

This invention relates to a container for particulate material, and more particularly, to a container for supplying toner and other material to a receiving device therefor in a copier, printer, or other such apparatus.

BACKGROUND ART

U.S Pat. No. 4,062,385, issued Dec. 13, 1977 to Katusha et al, shows a toner container with a broad flange at the bottom around an opening through which toner can be emptied. A cover for the container is slidably retained against the flange so that it can be moved between positions covering the opening and uncovering the opening. The container is usable with appropriate receiving apparatus on a copier. It is placed on a slide structure next to a toner sump cavity on the receiving apparatus. As the container is slid over the sump cavity the cover is retained on the slide by suitable detent means between the cover and the slide and sump. When the container is empty and to be removed it is slid back onto the cover so that it may be removed and disposed of without dirtying the operator or the apparatus.

This structure has been used extensively commercially and has successfully accomplished its mission of supplying toner in a clean environment. However, the slide and cover protrude substantially from the sump. To prevent the slide from interfering with the front door of the apparatus, the commercial use of this structure positions the slide parallel to the door, so that the container's movement is substantially parallel to that front door of the apparatus. This requires substantial room on one side of the receiving apparatus in the copier, which in fact has been available.

It would be desirable to use this toner container cover removing system in newer apparatus having a number of development stations, for example, apparatus capable of making multicolored reproductions. Unfortunately, such apparatus receives several, for example, as many as four, toner containers, one next to the other. Thus, the adjacent toner containers do not permit placement of the slide parallel to the front door and movement of the toner container off its cover in a direction parallel to the front door.

DISCLOSURE OF THE INVENTION

It is the object of the invention to provide a particulate material container which utilizes the covering and uncovering feature of the prior art mentioned above but which eliminates the protruding aspect of the cover and slide so that the cover is positioned in more compact space.

This and other objects are accomplished by a toner container having a containing portion with an opening at its bottom and a cover movable relative to said containing portion between positions covering and uncovering said opening substantially as in the prior art. However, the cover has a hinge around which a portion of the cover can be moved to an unprotruding position when in its uncovering position.

With this invention, the toner container can be slid off the cover and onto the sump cavity by movement in a direction perpendicular to the front door of the apparatus and then the cover bent to a position out of the way permitting closing the door.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
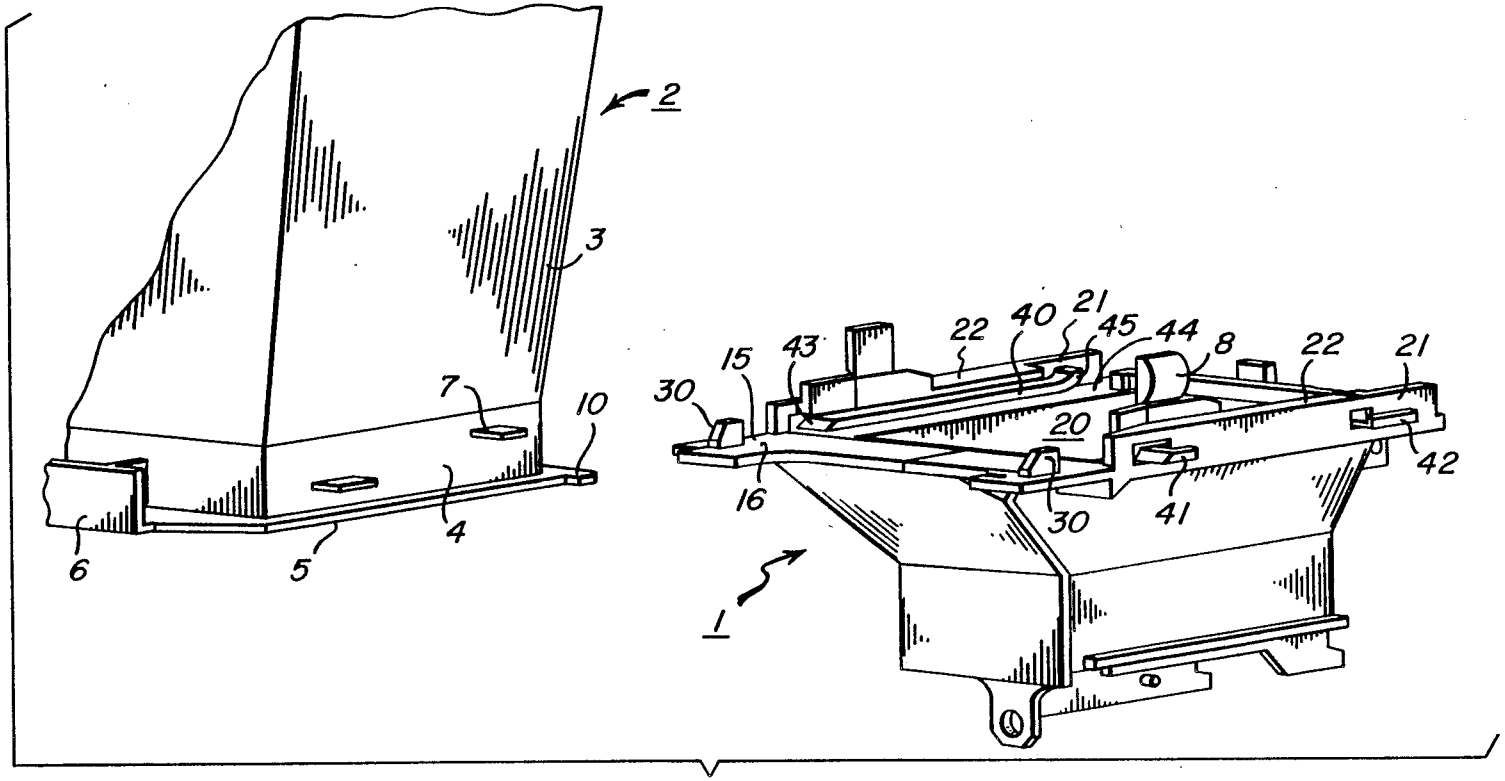
FIG. 1 is a perspective view of a portion of a toner container and a receiving apparatus constructed according to the invention.

Referring to FIG. 1*a* toner sump 1 is positioned to receive a toner container 2. In FIG. 1 the toner container 2 is shown without a cover, which cover is shown in FIGS. 2–5 and described below. The toner container 2 has a containing portion 3 for holding a supply of toner. The toner may include carrier particles for use in a two component process or include only toner for either a one or two component process. A bottom, interface portion 4 of the container portion 3 surrounds an opening 9 in the containing portion 3. Interface portion 4 includes an insert flange 5, a handle 6, and a protrusion from a side wall of the interface portion, toner identification tab 7 (described in more detail with respect to FIGS. 6–9). The leading end of insert flange 5 includes lateral extensions 10 which extend away from opening 9 (their function to be explained below). Ordinarily, the interface portions 4 of various size containing portions 3 would be identical.

Toner sump 1 includes a receiving surface 15 (see also FIG. 5) for receiving and guiding the bottom surface of insert flange 5 as the toner container 2 is moved to a position on the sump 1. The sump 1 includes a toner or sump cavity 20 for receiving toner from the container where it is mixed with carrier particles and fed to a development mechanism all by means well-known in the art and not shown herein. Side guides 21 having overhangs 22 help guide flange 5 as it is slid by the operator into position with opening 9 over cavity 20. Receiving surface 15 has an ingress surface portion 16 and a surface portion 44 generally alongside cavity 20. Once in position, overhangs 22 hold flange 5 to surface portion 44.

Referring to FIGS. 2–5, a rigid plastic cover 25 is held on flange 5 by angled side rails 26. Protrusions 29 engage the front of flange 5 when the cover is on the container 2. As seen best in FIG. 2, cover 25 includes a first portion 27 which has indents 28 or other suitable detent means and a second portion 11. Indents 28 allow the first portion 27 of the cover to be positioned behind protrusions 30 (FIGS. 1, 2 and 5) on ingress surface 16. The indents 28 cooperate with the protrusions 30 to prevent cover 25 from moving with flange 5 as the container 2 is moved by the operator rearward to a position with opening 9 over the sump cavity 20 as guided in part by receiving surface 15, side guides 21 and the inner surfaces of protrusions 30. Thus, the containing portion 3 of container 2 is slid away from cover 25 when the containing portion is moved over cavity 20.

Figure 4:
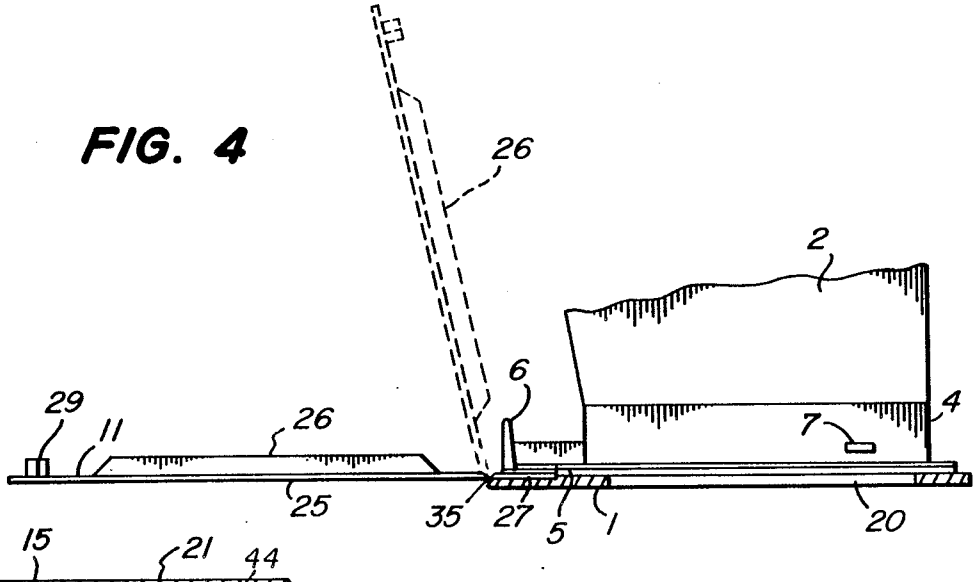
FIG. 4 is a side view of the toner container and cover shown in FIG. 2.

As shown best in FIG. 4, once the toner container 2 is positioned over the sump cavity 20 the cover 25 extends substantially to the left from the interface portion 4 of the container 2. In prior devices, it was common to move the toner container in a direction parallel to the front door of the apparatus into which it was being inserted, which meant that the cover did not interfere with closing of the door. However, the toner supply system shown herein is designed for apparatus with a number of development stations placed side-by-side. With such an arrangement it is not structurally possible to move the toner container according to the prior art, because it will be restricted by the toner container next to it.

Accordingly, the toner container shown in FIG. 1 is designed to be inserted directly from the front of the machine toward the back of the machine leaving the cover 25 in a position in which it can interfere with closing the front door of the apparatus. To solve this problem, the cover 25 itself includes a hinge 35 across the direction of movement of the containing portion 3 about which the second portion 11 may be rotated to a position shown in phantom in FIG. 4, where it is out of the way and not restricting of the rest of the apparatus, i.e., it allows the front door of the apparatus to be closed. The hinge can be a conventional thinning of the plastic cover.

Figure 2:
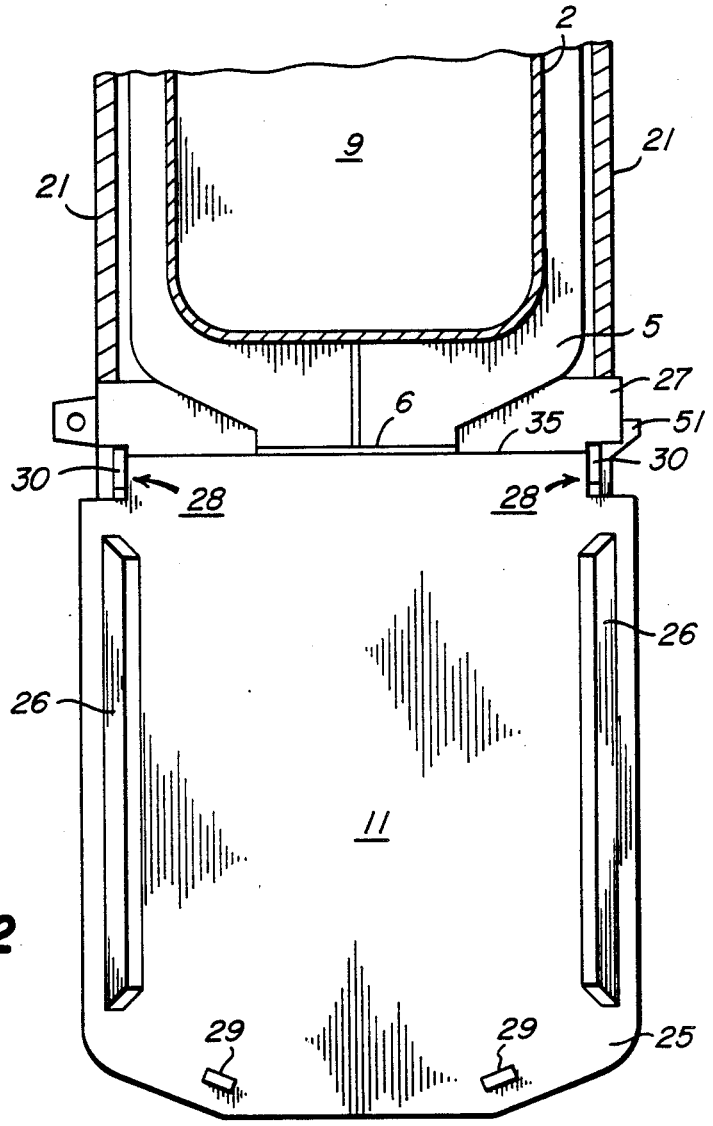
FIG. 2 is a top section of a portion of a toner container with its cover in a removed position with a few portions of a toner sump shown.

After the toner bottle is empty, the cover 25 is lowered to its extended position shown best in FIGS. 2 and 4, and the toner container is slid back out onto the cover (a position beside or to the side of the sump cavity) for removal and disposal with a minimum loss of unused toner and a minimum of dirtying the person and clothing of the operator.

Figure 5:
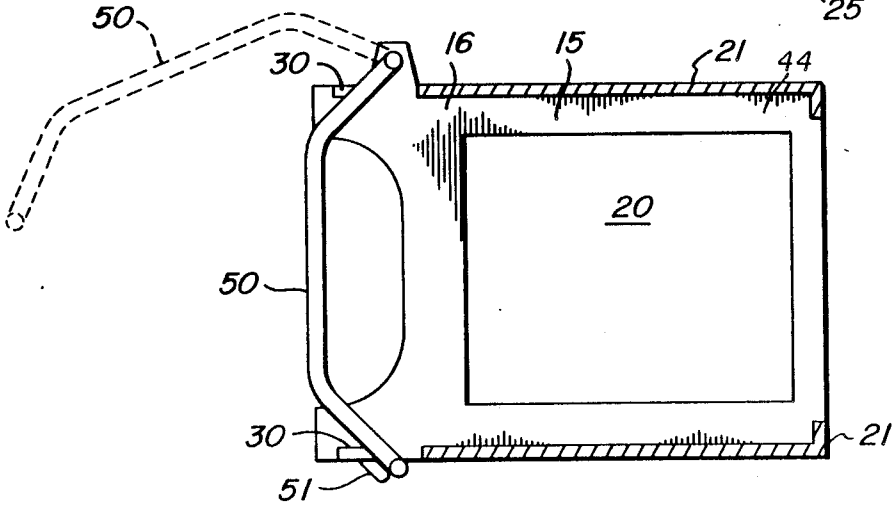
FIG. 5 is a top view of a toner sump, portions of which are shown in in FIGS. 2, 3 and 4.

FIG. 5 shows a gate 50 which can be swung open to permit access to the sump for the container 2. After the containing portion 3 has been moved over the sump cavity 20 and the cover 25 has been bent about hinge 35 to its raised position, the gate 50 is closed and lodged behind a detent 51 where it holds the cover in its raised position. The gate 50 also pushes the cover into container 2 assuring that container 2 is completely inserted over sump cavity 20.

Figure 3:
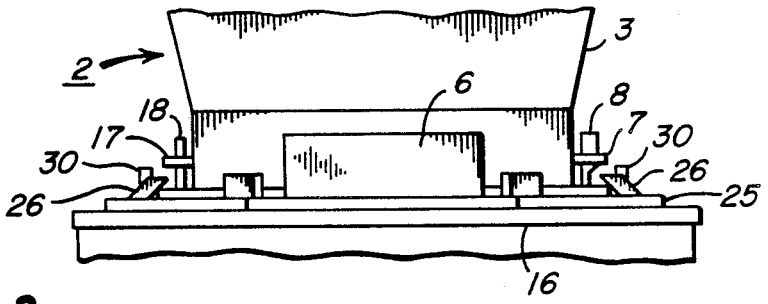
FIG. 3 is a front view of the bottom portion of the toner container and cover shown in FIG. 2 with a few portions of the toner sump shown.

To enable the use of common parts for more than one apparatus the toner container 2 in combination with the sump 1, contains a system for discriminating between two different types of toner. According to FIGS. 6–9, when toner container 3 is manufactured it contains tabs 7 and 17, tab 7 is also shown in FIG. 1. Both tabs 7 and 17 are also shown in FIG. 3 for illustration, although, in fact, both would not be present in any one use. Tabs 7 and 17 are shown as molded protrusions from opposite side walls of interface portion 4, which side walls are generally parallel to the direction of movement of the container as it moves over sump cavity 20. However, they can be any removable protrusions from opposite sides of the lower part of the container. For example, they could be protrusions upward from insert flange 5.

According to the type of toner placed in container 3, one of the tabs is removed in the factory. The toner container shown in FIGS. 6 and 7 contains a first toner and has tab 7 eliminated leaving only tab 17 on the left side of the toner container. The toner container shown in FIGS. 8 and 9 contains a second toner and has tab 17 eliminated leaving only tab 7 on the right side. The toner sump 1 also has removable interfering means, for example, sump tabs 8 or 18, either of which can be eliminated in the field by a service person or in the factory. Both sump tabs 8 and 18 are shown in FIGS. 1 and 3 for illustration, although at least one would be eliminated in actual use. They are made to be removable by hand, i.e., merely by bending off.

Figure 6:
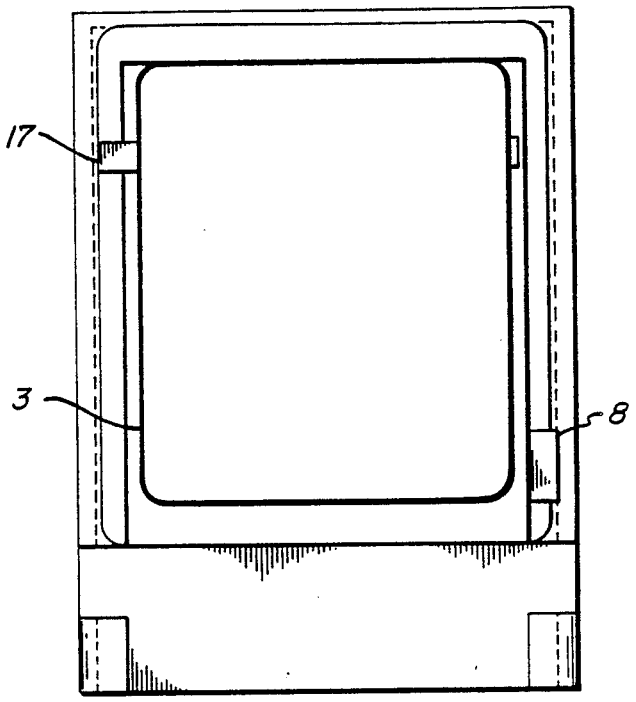
FIGS. 6 and 7 are top and front simplified views of a toner container–receiving apparatus interface illustrating the use of toner identification tabs for a first toner.
Figure 7:
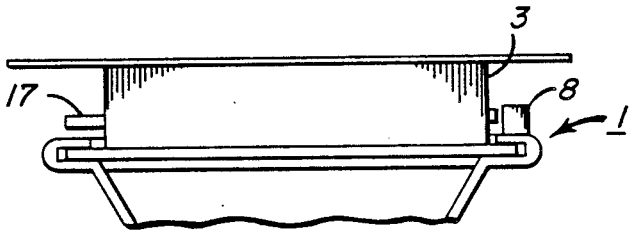
Figure 8:
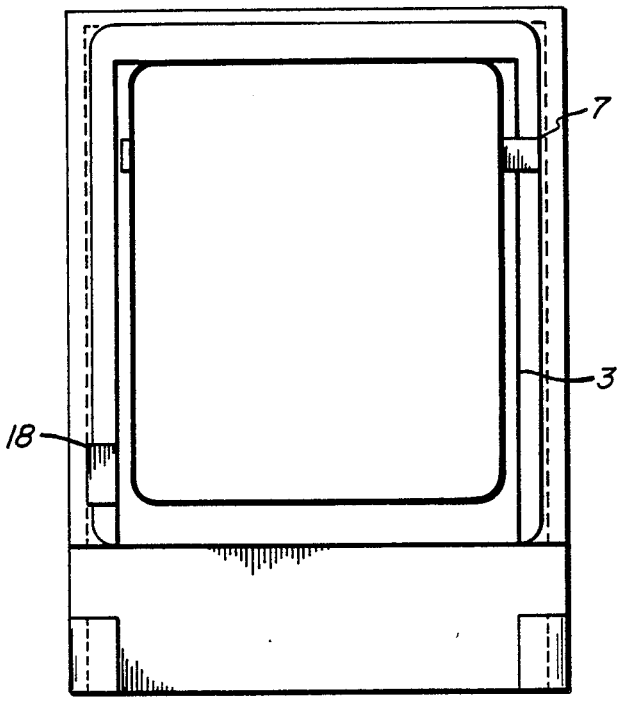
FIGS. 8 and 9 are top and front schematic views similar to FIGS. 6 and 7 illustrating the use of toner identification tabs for a second toner.
Figure 9:
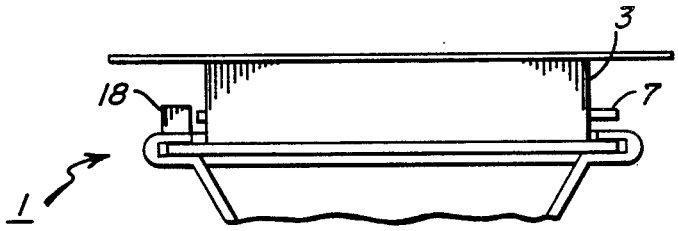

For a sump that is to receive a first toner, the tab 8 is allowed to remain and the tab 18 is eliminated (FIGS. 6 and 7). For a sump that is to receive a second toner, as shown in FIGS. 8 and 9, the tab 18 remains while the tab 8 has been eliminated. If an operator attempts to put a container containing a second toner into a sump adapted for a first toner, sump tab 8 will interfere with container tab 7 and prevent insertion of the toner container to its position above the sump. Similarly, if an operator attempts to put a toner container with a second toner onto a sump adapted for the first toner, tab 18 will interfere with tab 17 to prevent that insertion. The correct toner is permitted, as shown best in FIGS. 7 and 9.

Any of the four tabs can be easily eliminated manually. Therefore, all containers and sumps may be machine manufactured identically using the same molds. The adjustment for the type of toner made is then a manual or machine severing process, i.e., it is cut off. This feature is very useful in the manufacture of designs of closely related models of a copier or printer which use different materials. For example, a color model may be designed to take one type of toner, for example, a toner compatible with a fuser using other color toners, while another model receives a toner adapted for a black only machine which may not be compatible with a fuser for the color toners, but may have other advantages. The system can also be used for a single apparatus that receives two colors of toner in development sumps which are identical except for tabs, for example, a black station and a red or other color station. It can also be used in a single apparatus that takes a magnetic black toner and a non-magnetic black toner in essentially identical sumps.

Prior toner supply systems similar to the one disclosed herein lose some toner into the workings of the machine through a skiving process created by structure similar to flange 5. This problem is best seen with respect to FIG. 1. As the toner container 3 is slid into position above the sump cavity 20, the leading edge of flange 5, in the prior art, will sometimes skive a certain amount of toner already in or around the sump into the workings of the machine. It is well recognized that airborne or otherwise loose toner is an enemy of the entire machine as well as the operator.

In the apparatus shown in FIG. 1, this problem is corrected through the combination of a pair of ski shaped, elongated inserts 40 called "skis" herein and the extensions 10 on insert flange 5. Skis 40 are inserts loosely held to side guides 21 by tabs 41 and 42. A first end (leftmost in FIG. 1) of each ski has a cam surface, for example, a ramp 43 which guides extensions 10 and therefore the leading part of insert flange 5 to the top of skis 40. As the container 2 is pushed by the operator to its position over sump cavity 20, extensions 10 ride along the top of skis 40 as skis 40 rest on surface portion 44 on opposite sides of or surrounding sump cavity 20.

Skis 40 are ramped upward at the other or second end 45 opposite ramp 43. As the operator pushes containing portion 3 into the machine, the extensions 10 move beyond the ramped end 45 and settle down on top of surface 44. When the containing portion 3 is removed from the sump 1, for example, when it is empty, the flange extensions 10 engage the bottom of ramped end 45 which is a cam surface forcing the extensions and hence the flange to slide on surface 44 underneath skis 40 (which are moved upward). The containing portion moves toward the left until it has re-combined with cover 25 and can be removed. Thus, the ski-shaped inserts 40 are a means for guiding the leading portion of flange 5 through a "high" path, a path separated from surface 44, as the containing portion is moved over the cavity 20 and along a low path, for example, a path in contact with surface 44 as the containing portion returns to its position beside the cavity 20. As containing portion 3 moves to the left (as shown in FIG. 1), the inside edge of the now trailing inside vertical wall of interface portion 4 skives toner also toward the left. When it reaches the left most edge defining sump cavity 20 the toner must either go down into the cavity or into the toner container above the cover 25. It is not free to soil the operator's person or damage the operation of the equipment. When the next container is placed on the machine, as described above, the flange extensions 10 force the containing portion through a higher path than the path left by the skiving empty containing portion that had just been removed. Because of the skiving action at a lower position in the removal process, little, if any toner is in a position to be skived by the higher path taken by the leading edge of flange 5 during toner container insertion. Thus, the effect of toner being skived into the workings of the machine is greatly reduced or eliminated. This advantage is the same even if flange 5 does not extend forward of the rest of the containing portion 4, since a vertical front wall of the interface portion would also have the problematic skiving effect.

The receiving surface 15 including surface portion 44 surrounding sump cavity 20 can be covered by a cloth, felt, fiber or other compressible material to assist in a leakproof fit between the container 2 and the sump 1, as is well-known in the art. The skis 40 guide the leading edge of the flange 5 to a position over its final inserted position and then down on the cloth or fiber material on surface 44. The cloth or fiber also prevents looseness as flange 5 is held in place by overhangs 22 despite room being provided between overhangs 22 and surface 44 for the two paths of flange 5.

A paper seal, not shown, can be employed over the bottom of container 2. Such seals are common in the industry. For example, the seal can be adhesively affixed to the bottom of flange 5 to seal the container. The seal would be attached beginning with an edge of the seal at the trailing (during insertion) or handle edge of flange 5 and running across the container opening to the leading edge adjacent flange extensions 10. The seal is folded and doubled back upon itself to an accessible end extending from between flange 5 and cover 25. The end is accessible in the vicinity of handle 6. After the container 2 has been positioned above sump 1 and before the cover has been bent to its upwardly position the accessible end of the seal is pulled to remove it allowing the toner to drop into the sump. The paper seal is then thrown away, the cover bent up and the gate closed.

The invention has been described in detail with particular reference to a preferred embodiment thereof, but it will be understood that variations and modifications can be effected within the spirit and scope of the invention as described hereinabove and as defined in the appended claims.

We claim:

1. A container for supplying toner to a receiving apparatus, said container having:

a containing portion having an opening and an interface portion surrounding said opening, a rigid cover engaging said interface portion for covering the opening, the cover having first and second portions and being slidable relative to the interface portion from a covering position to an uncovering position, with said second portion protruding from said containing portion, and a hinge in the cover permitting the second portion of the cover to be bent about said hinge to an unprotruding position when said cover is not covering said opening.

2. A container for supplying toner to receiving apparatus, said receiving apparatus being generally of the type having a sump cavity for receiving toner from a container positioned above the cavity and a surface surrounding the cavity on which the container rests, said container comprising:

a containing portion having a bottom with an opening positionable over said sump cavity, a flange adjoining the opening and forming the bottom surface of the containing portion and positionable on said surface surrounding the sump cavity, and a rigid cover engaging said flange and having first and second portions, and being slidable with respect to said flange from a position covering said opening when said container is not above said sump cavity to a position uncovering said opening with said second portion protruding from said container when said container is on said sump cavity, said cover having a hinge separating said portions and permitting bending said second portion of said cover about said hinge to a position generally vertical when said cover is in an uncovering position and said container is over said cavity.

3. A container for supplying toner to a receiving apparatus, said receiving apparatus being generally of the type having a sump cavity for receiving toner from a container positioned above the cavity and a receiving surface surrounding said cavity on which the container rests, such surface having an ingress surface portion and having protrusion means associated with the ingress portion, said container comprising:

a containing portion having an opening for positioning over the sump cavity of a receiving apparatus, a flange adjoining the opening for positioning on said receiving surface, a cover for covering the opening and having means for slidably engaging said flange to retain said cover against the bottom surface of said flange but permit sliding of the cover with respect to said flange between positions covering and uncovering said opening, said cover further including indent means from at least one lateral edge of said cover and engageable with the protrusion means of a receiving apparatus to prevent movement of the cover, with respect to the apparatus, while the containing portion is being slid to a position over said sump cavity, and first and second portions separated by a hinge, said second portion being rotatable around said hinge to a nonprotruding position when said containing portion is positioned over said sump cavity.

4. A container for supplying toner to a receiving apparatus, said receiving apparatus being generally of the type having a sump cavity for receiving toner from a container positioned above the cavity and a receiving surface surrounding said cavity on which the container rests, such surface having an ingress surface portion and having protrusion means associated with the ingress portion, said container comprising:

a containing portion having an opening in its bottom for positioning over the sump cavity of a receiving apparatus, a flange adjoining the opening for positioning on the receiving surface of a receiving apparatus, a cover for covering the opening and having means for slidably engaging said flange to retain said cover against the bottom surface of said flange but permit sliding of the cover with respect to said flange between positions covering and uncovering said opening, said cover further including:

first and second portions, a hinge separating said first and second portions and extending generally across the direction of said movement of the cover with respect to the flange, said second portion being rotatable around said hinge when said cover is in its uncovering position, and detent means engageable with the protrusion means of the ingress surface portion of a receiving apparatus to prevent movement of the cover while the containing portion is being slid both to a position over said sump cavity with the cover in its uncovering position and back to a position beside the cavity with the cover in its covering position.

* * * * *